US010156101B2

(12) United States Patent
Britton

(10) Patent No.: US 10,156,101 B2
(45) Date of Patent: Dec. 18, 2018

(54) BUOYANCY SYSTEM FOR MARINE RISER

(71) Applicant: Cameron International Corporation, Houston, TX (US)

(72) Inventor: Jim Britton, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/233,470

(22) Filed: Aug. 10, 2016

(65) Prior Publication Data

US 2018/0044996 A1 Feb. 15, 2018

(51) Int. Cl.
*E21B 17/01* (2006.01)

(52) U.S. Cl.
CPC ..... *E21B 17/012* (2013.01)

(58) Field of Classification Search
CPC ..... E21B 17/012; E21B 17/017; B63B 22/00
See application file for complete search history.

(56) References Cited

U.S. PATENT DOCUMENTS 4,596,531 A * 6/1986 Schawann ..... F16L 1/24 166/350
6,524,152 B1 * 2/2003 Dauphin ..... F16L 1/24 166/367
7,008,141 B2 * 3/2006 Fitzgerald ..... B63B 21/502 166/350
8,322,438 B2 * 12/2012 Larson ..... E21B 17/012 138/106
8,827,338 B2 * 9/2014 Biggert ..... B66C 1/44 294/119.2
8,960,304 B2 * 2/2015 Luppi ..... E21B 17/015 166/345
2011/0253027 A1 * 10/2011 Legras ..... B63B 22/025 114/333

FOREIGN PATENT DOCUMENTS

WO WO 2016056914 A2 * 4/2016 ..... E21B 17/012

* cited by examiner

*Primary Examiner* — Matthew R Buck
(74) *Attorney, Agent, or Firm* — Helene Raybaud

(57) ABSTRACT

A marine riser system, a buoyancy system, and a method of buoying a body. A riser joint includes a body, a buoyancy module, a thrust collar, and a reaction collar. The buoyancy module is coupled around the body and configured to produce a buoyant force when submerged at a subsea location. The thrust collar is coupled around the body and engaged with the buoyancy module to transfer the buoyant force to the body. The reaction collar is engaged with the body such that movement of the buoyancy module is restricted by the reaction collar.

18 Claims, 3 Drawing Sheets

BUOYANCY SYSTEM FOR MARINE RISER

CONTEXT

This section is intended to provide relevant contextual information to facilitate a better understanding of the various aspects of the described embodiments. Accordingly, it should be understood that these statements are to be read in this light and not as admissions of prior art.

Drilling and production operations for the recovery of offshore deposits of crude oil and natural gas are taking place in deeper and deeper waters. Drilling and production operations in deeper waters are typically carried out from floating offshore vessels rather than from stationary platforms resting on the ocean floor and commonly used in shallow water. According to conventional procedures, an offshore vessel is dynamically stationed, or moored, above a well site on the ocean floor. After a wellhead has been established, a blowout preventer ("BOP") stack is mounted on the wellhead to control the pressure in the wellhead. After drilling is completed, a production tree is mounted on the wellhead to control produced fluids.

Subsea wellbores extend into the earth and may be cased with a casing string that extends into the wellbore from a wellhead and is cemented within the wellbore. The drilling, casing installation, and cementing are performed through one or more risers that extend from the wellhead to the surface, such as to the offshore vessel. After drilling operations are performed and the well is completed, produced fluids may travel to the surface through one or more risers that extend from the wellhead to the surface.

Risers comprise a series of connected riser joints. A single riser joint can weigh in excess of 20,000 pounds (9,000 kg) and exceed 80 feet (24 meters) in length. To reduce the amount of tension maintained by the offshore vessel, the riser joint can be equipped with a buoyancy module to make it close to neutrally buoyant when submerged underwater. The buoyancy module is coupled to the riser to increase its buoyancy and facilitate handling of the riser underwater. The buoyancy module can be a cylindrical unit that is positioned around and secured to the riser joint. Thrust collars are secured near each end of the riser joint to transfer the axial buoyancy load of the buoyancy modules to the riser joint and thus the riser.

BRIEF DESCRIPTION OF THE DRAWINGS

For a detailed description of the embodiments, reference will now be made to the accompanying drawings in which.

DETAILED DESCRIPTION

This disclosure describes a buoyancy system for a marine riser joint. Specifically, this disclosure describes a reaction collar that engages a thrust collar on the marine riser joint to resist axial movement of the thrust collar and a buoyancy module.

Figure 1:
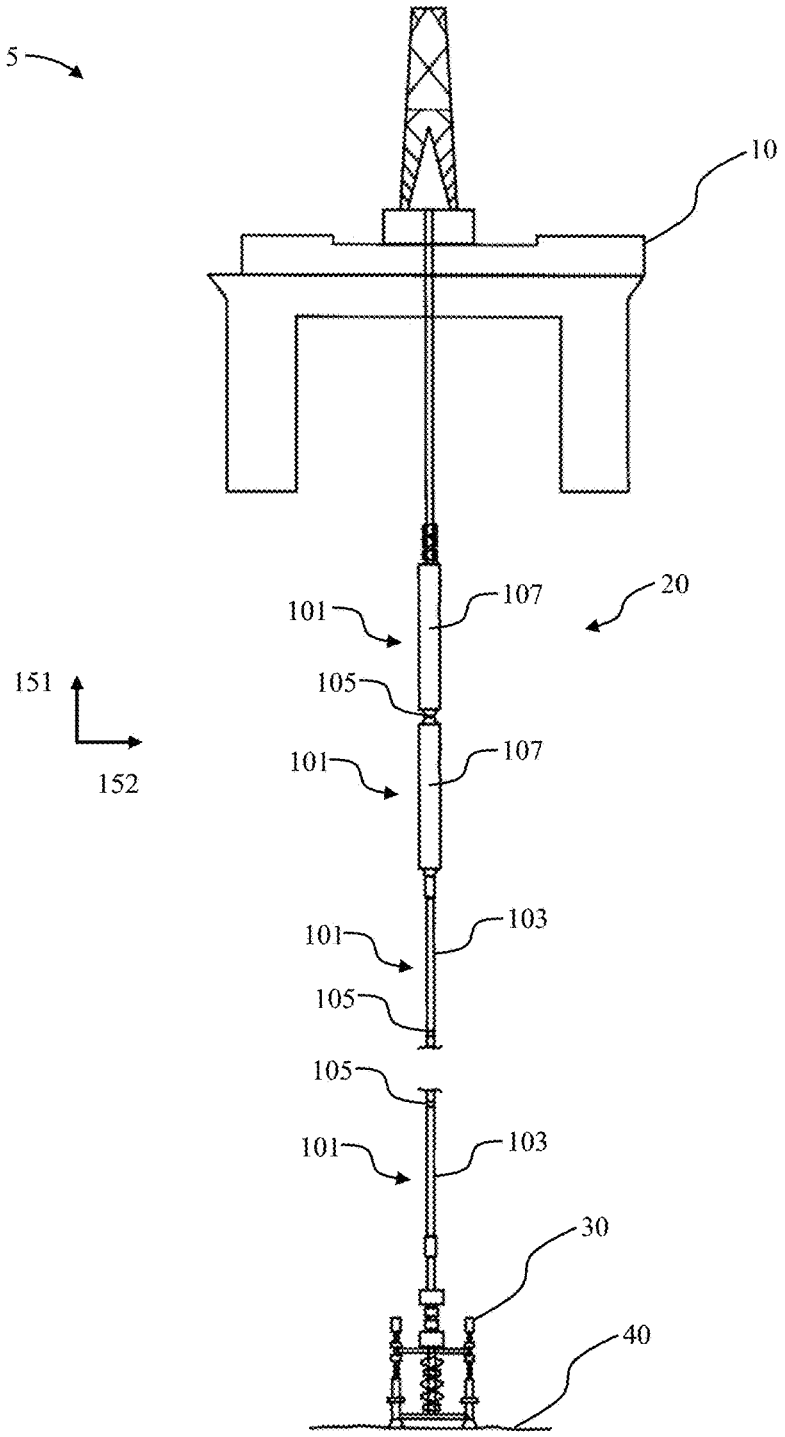
FIG. 1 shows a schematic view of a subsea drilling system, according to one or more embodiments.

FIG. 1 shows a schematic view of a subsea drilling system 5, in accordance with one or more embodiments. As shown, the subsea drilling system 5 includes an offshore vessel 10, a riser string 20, and a BOP stack 30. The riser string 20 extends from the offshore vessel 10 to the BOP stack 30 located on an ocean floor 40. The riser string 20 includes a plurality of riser joints 101, each including a body 103 connected in an end-to-end relationship by flanges 105. One or more of the riser joints 101 includes a buoyancy module 107 clamped to, coupled to, or otherwise engaged with the body 103. In the following discussion, reference may be made to various directions or axes, such as a y-axis or direction 151, and an x-axis or direction 152, as represented schematically on FIGS. 1-3. It should be appreciated that these axes are in relation to the orientation of the riser string 20 and not set axes.

Figure 2:
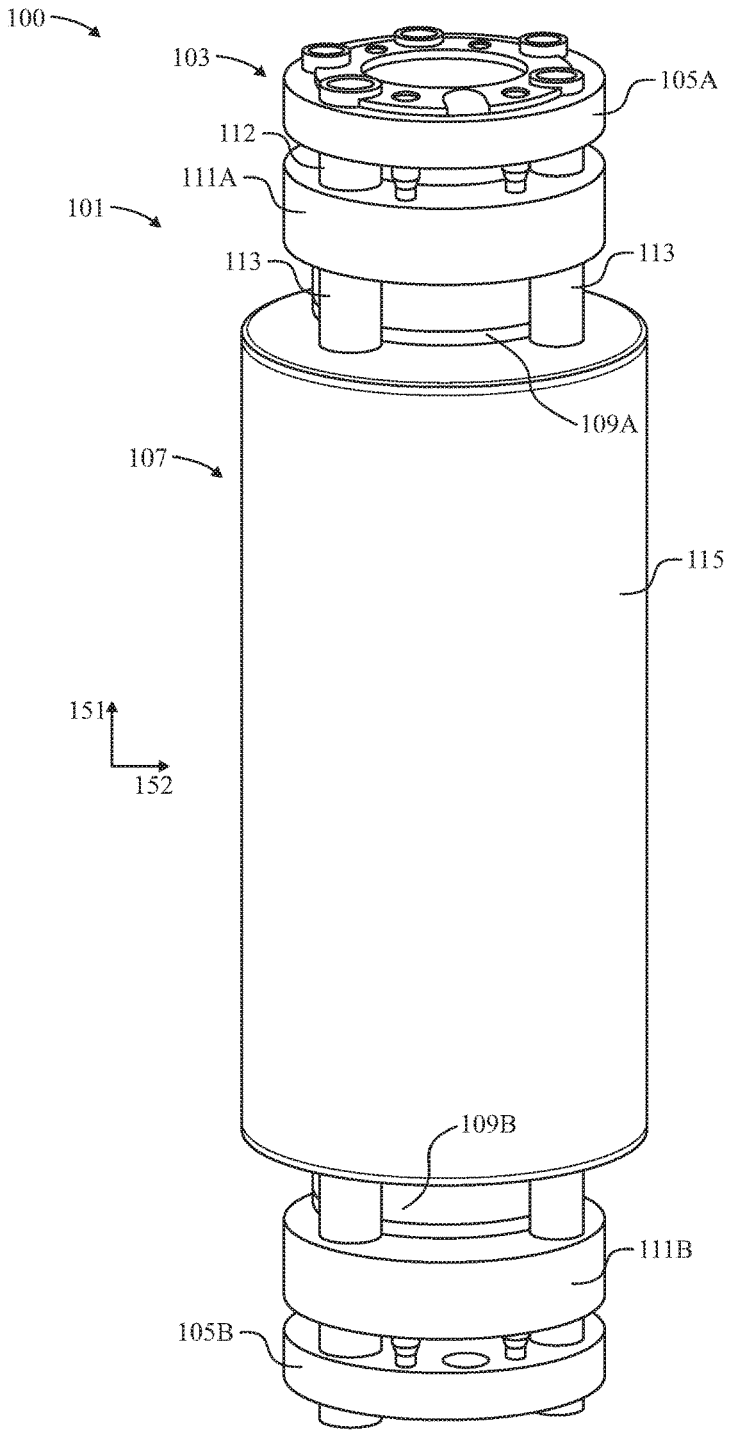
FIG. 2 shows an axonometric view of a riser joint, according to one or more embodiments.

FIG. 2 shows an axonometric view of a marine riser joint 101 that may be used as part of an overall marine riser system 100, in accordance with one or more embodiments. As shown, the riser joint 101 includes a body 103, a buoyancy module 107, one or more thrust collars 109A and 109B, one or more reaction collars 111A and 111B, and auxiliary lines 113. Although shown as generally tubular, it should be appreciated that the body 103 may be any suitable configuration.

The buoyancy module 107 includes an annular housing 115 that can be filled with a compressed fluid (e.g., a gas) or foam adapted to apply buoyant force in an upward direction (e.g., generally along a y-axis 151 assuming the riser string 20 (FIG. 1) is oriented vertically) to the riser joint 101 to which it is coupled or engaged, reducing or obviating the need for the offshore vessel 10 (FIG. 1) to maintain tension on the riser string 20 (FIG. 1). The buoyancy module 107 is coupled around a portion of the body 103 such that it is slidable along the body 103 and configured to produce the buoyant force when submerged at a subsea location.

The thrust collars 109A, 109B are fastened to the body 103 at each distal end of the buoyancy module 107 to secure the buoyancy module 107 in place on the body 103. The thrust collars 109A, 109B can be fastened by bolting arcuate segmented pieces together, creating a tight friction fit around the body 103 that restricts axial movement (e.g., along the y-axis 151). Each of the thrust collars 109A, 109B engages the body 103 and the buoyancy module 107 so that one of the thrust collars (e.g., 109A) can transfer an upward buoyant force (e.g., along the y-axis 151) applied from the buoyancy module 107 to the body 103, thus counteracting a downward force (e.g., along the y-axis 151) applied from the mass of the riser joint 101. However, the fastening mechanism of the thrust collars 109A, 109B is also susceptible to disengaging its frictional fit around the body 103, allowing the buoyancy module 107 to axially move along the body 103.

To account for potential movement of the thrust collars 109A, 109B, the riser joint 101 further includes the reaction collars 111A, 111B. The reaction collars 111A, 111B are coupled around the body 103 by fastening segments together and are separated from each distal end of the buoyancy module 107 on the body 103. The reaction collars 111A, 111B engage the body 103 between the thrust collars 109A, 109B and the flanges 105A, 105B, respectively, to secure the thrust collars 109A, 109B in place. As an example, the reaction collar 111A engages the thrust collar 109A and a portion of the body 103 that increases in outer width to restrict axial movement (e.g., along the y-axis 151) of the thrust collar 109A and buoyancy module 107 along the body 103 towards the flange 105A. Further, the reaction collars 111A, 111B may include channels 112 configured to receive the auxiliary lines 113 allowing the auxiliary lines 113 to pass through the reaction collars 111A, 111B.

In one or more embodiments, the reaction collars 111A, 111B may include an elastomeric material between an outer surface of the body 103 and an inner surface of the reaction collars 111A, 111B to increase a frictional force between the body 103 and the reaction collars 111A, 111B and further restrict axial movement towards the flanges 105A, 105B as explained further below. The reaction collars 111A, 111B may include at least two arcuate segments fastened or bolted together to couple around the body 103. In one or more embodiments, the reaction collars 111A, 111B may be integral with the body 103 and/or the thrust collars 109A, 109B. The reaction collars 111A, 111B and the thrust collars 109A, 109B may be integral with the buoyancy module 107. In one or more embodiments, one of the reaction collars 111A, 111B may include two or more collars axially spaced along the body 103 between the respective thrust collar 109A, 109A) and flange 105A, 105B with one collar directly engaging the respective thrust collar 109A, 109B. The auxiliary lines 113 can include hydraulic control lines (e.g., choke and kill lines) for delivering pressurized fluid to subsea equipment, such as to the BOP stack 30. The flanges 105A, 105B are configured to be connected with a flange of another section of a riser joint 101 by bolts, dogs, or other suitable fasteners. Each end of the body 103 and the auxiliary lines 113 mates with a corresponding end of a different instance of the riser string 20 to form fluid channels between the offshore vessel 10 and the BOP stack 30.

Figure 3:
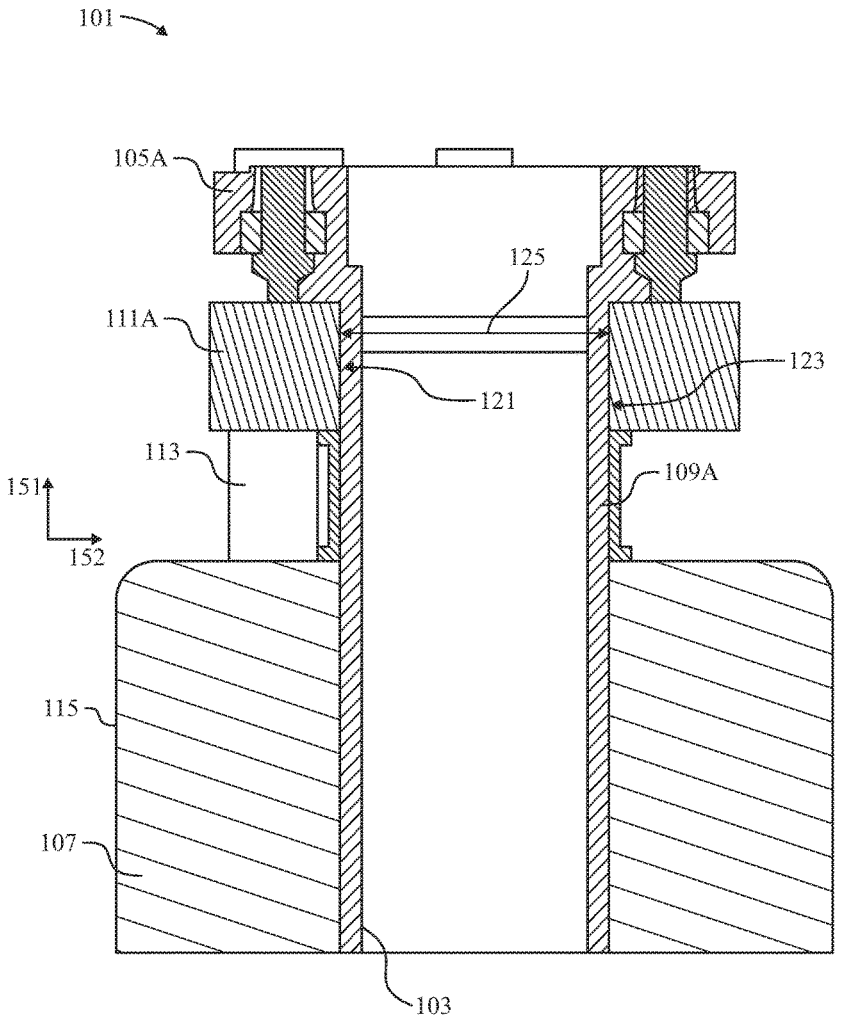
FIG. 3 shows a cross-section view of the riser joint of FIG. 2, according to one.

FIG. 3 shows a cross-section view of a portion of the riser joint 101 of FIGS. 1 and 2, in accordance with one or more embodiments. Although this discussion is directed to the reaction collar 111A, it should be appreciated that the scope of the reaction collar 111A is also applicable to the reaction collar 111B. As shown, the buoyancy module 107 contacts the thrust collar 109A, which contacts the reaction collar 111A, allowing a force applied in an axial direction (e.g., along the y-axis 151) towards the flange 105A through the thrust collar 109A to be transferred to the reaction collar 111A, which in turn, transfers this force to the tubular body 103 as described herein.

A portion of the body 103 includes a conical outer surface 121 with an outer diameter (e.g., a diameter 125) that increases towards the flange 105A. A similar profile may be included on the portion proximate the opposite flange 105B. In one or more embodiments, the portion of the body 103 may increase in outer width in the form of a conical frustum, a pyramidal frustum, an ellipsoidal frustum, an elliptic conical frustum, one or more rings, one or more prisms, any suitable shape that increases in outer width towards the flange 105A, or a combination thereof. Additionally, or alternatively, the reaction collar 111A may be adapted to engage or match the portion of the body 103 that increases in outer width to transfer axial forces towards the flange 105A to the body 103 and restrict axial movement.

The reaction collar 111A includes a conical inner surface 123 that matches or engages a part of the conical outer surface 121, restricting further axial movement of the reaction collar 111A towards the flange 105A. The engagement of the inner surface 123 of the reaction collar 111A with the conical outer surface 121 of the body 103 thus allows forces to be transferred from the buoyancy module 107 to the body 103.

It should be appreciated that without a reaction collar (111A or 111B) being engaged by a respective thrust collar (109A or 109B), the force applied to the thrust collar (109A, 109B) from the buoyancy module 107 can disengage the thrust collar (109A, 109B) from its fastened positioned on the riser joint 101, especially as the riser joint is being deployed to a subsea location. When the thrust collar (109A, 109B) disengages from its fastened position on the riser joint 101, this allows the buoyancy module 107 to move axially along the riser joint 101 and, in turn, allows the thrust collar (109A, 109B) to strike the flange (105A, 105B), potentially damaging the riser joint 101 or the auxiliary lines 113. Thus, the reaction collars 111A, 111B prevent the thrust collars 109A, 109B from disengaging from the riser joint 101 and provide a mechanism for restricting axial movement of the thrust collars 109A, 109B and buoyancy module 107.

This discussion is directed to various embodiments. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of one or more embodiments, except to the extent that they are included in the accompanying claims.

What is claimed is:

1. A marine riser system, comprising:

a riser string comprising a riser joint and auxiliary lines, the riser string joint including:

a body;

a buoyancy module coupled around the body and configured to produce a buoyant force when submerged at a subsea location;

a thrust collar coupled around the body and engaged with the buoyancy module to transfer the buoyant force to the body; and a reaction collar engaged with and coupled around the body to transfer the buoyant force from the thrust collar to the body with the auxiliary lines extending through the reaction collar such that movement of the buoyancy module is restricted by the reaction collar.

2. The marine riser system of claim 1, wherein a portion of the body includes a conical outer surface and the reaction collar comprises an inner surface engaged with the conical outer surface and smaller than the conical outer surface so as to prevent movement of the reaction collar past the conical outer surface.

3. The marine riser system of claim 1, wherein the body comprises a flange and the reaction collar is located between the thrust collar and the flange.

4. The marine riser system of claim 1, wherein the reaction collar comprises segments fastened together around the body.

5. The marine riser system of claim 1, wherein the reaction collar comprises an elastomeric material on an inner surface engaged with the body.

6. The marine riser system of claim 1, further comprising:

an additional thrust collar engaged with a distal end of the buoyancy module opposite to the end engaged with the thrust collar;

an additional reaction collar engaged with the additional thrust collar.

7. The marine riser system of claim 1, wherein the reaction collar is integral with the body.

8. The marine riser system of claim 1, wherein the thrust collar and the reaction collar are integral with the buoyancy module.

9. A method of buoying a riser joint comprising a body and auxiliary lines, the method comprising:

buoying the body with a buoyancy module coupled around the body that produces a buoyant force when submerged at a subsea location;

restricting movement of the buoyancy module along the body with a thrust collar coupled around the body and engaging the buoyancy module, thereby transferring the buoyant force to the body; and restricting movement of the buoyancy module along the body with a reaction collar engaging and coupled around the body with the auxiliary lines extending through the reaction collar thereby transferring the buoyant force from the thrust collar to the body.

10. The method of claim 9, wherein buoying further comprises coupling the thrust collar to the body between the reaction collar and the buoyancy module.

11. The method of claim 9, wherein restricting further comprises transferring at least in part the buoyant force applied from the thrust collar to the body through the reaction collar.

12. The method of claim 9, wherein restricting further comprises fastening segments of the reaction collar together and around the body.

13. The method of claim 9, wherein restricting further comprises:

coupling an additional thrust collar around the body to engage a distal end of the buoyancy module opposite to the end engaged with the thrust collar; and coupling an additional reaction collar around the body to engage the additional thrust collar.

14. The method of claim 9, wherein restricting further comprises engaging a portion of the body that includes a conical outer surface with an inner surface of the reaction collar.

15. A buoyancy system for buoying a body, comprising:

a buoyancy module coupled around the body and configured to produce a buoyant force when submerged at a subsea location;

a thrust collar coupled around and movable with respect to the body and engaged with the buoyancy module to transfer the buoyant force to the body; and a reaction collar coupled around and movable with respect to the body and engaged with the thrust collar to transfer the buoyant force from the thrust collar to the body such that movement of the buoyancy module is restricted by the reaction collar.

16. The system of claim 15, wherein a portion of the body includes a conical outer surface and the reaction collar comprises an inner surface that is engaged with a part of the conical outer surface.

17. The buoyancy system of claim 15, wherein the reaction collar comprises segments fastened together around the body.

18. The buoyancy system of claim 15, further comprising an additional reaction collar coupled around the body and separated from a distal end of the buoyancy module, wherein the reaction collar is separated from a proximal end of the buoyancy module that is opposite the distal end of the buoyancy module.

* * * * *